US011662082B2

(12) United States Patent
Saarnio

(10) Patent No.: US 11,662,082 B2
(45) Date of Patent: May 30, 2023

(54) OPTICAL DEVICE FOR MODIFYING LIGHT DISTRIBUTION

(71) Applicant: LEDIL OY, Salo (FI)

(72) Inventor: Olli Saarnio, Salo (FI)

(73) Assignee: LEDIL OY, Salo (FI)

( * ) Notice: Subject to any disclaimer, the term of this patent is extended or adjusted under 35 U.S.C. 154(b) by 0 days.

(21) Appl. No.: 17/601,564

(22) PCT Filed: Jan. 17, 2020

(86) PCT No.: PCT/FI2020/050029

§ 371 (c)(1),
(2) Date: Oct. 5, 2021

(87) PCT Pub. No.: WO2020/208292

PCT Pub. Date: Oct. 15, 2020

(65) Prior Publication Data

US 2022/0196225 A1 Jun. 23, 2022

(30) Foreign Application Priority Data

Apr. 8, 2019 (FI) ..... 20195287

(51) Int. Cl.
*F21V 14/06* (2006.01)
*F21V 5/00* (2018.01)
(Continued)

(52) U.S. Cl.
CPC ..... *F21V 14/06* (2013.01); *F21V 5/008* (2013.01); *F21V 7/0091* (2013.01); *F21V 17/02* (2013.01)

(58) Field of Classification Search
CPC ..... F21V 14/06; F21V 5/008; F21V 17/02
See application file for complete search history.

(56) References Cited

U.S. PATENT DOCUMENTS 2,848,601 A 8/1958 Beach
3,020,396 A 2/1962 Worboys
(Continued)

FOREIGN PATENT DOCUMENTS

CN 111878782 * 11/2020 ..... F21V 14/06
DE 20 2017 103 122 5/2018
(Continued)

OTHER PUBLICATIONS

International Search Report for PCT/FI2020/050029 dated Apr. 6, 2020, 4 pages.
(Continued)

*Primary Examiner* — Julie A Bannan
(74) *Attorney, Agent, or Firm* — Nixon & Vanderhye

(57) ABSTRACT

An optical device includes first and second optical elements rotatable with respect to each other around a geometric optical axis of the optical device. The first optical element includes a first surface for modifying a distribution of light exiting the first optical element, and the second optical element includes a second surface facing towards the first surface and for further modifying the distribution of the light. One of the first and second surfaces includes convex areas whereas the other one of these surfaces includes concave areas so that an optical effect of the optical device is changeable by rotating the first and second optical elements with respect to each other. The first and second optical elements include sliding surfaces for mechanically supporting the second optical element with respect to first optical element in radial directions perpendicular to the geometric optical axis.

16 Claims, 8 Drawing Sheets

(51) Int. Cl.
*F21V 7/00* (2006.01)
*F21V 17/02* (2006.01)

(56) References Cited

U.S. PATENT DOCUMENTS

| | | | |
|---|---|---|---|
| 4,316,241 | A | 2/1982 | Gulliksen |
| 5,775,799 | A | 7/1998 | Forkner |
| 6,115,181 | A | 9/2000 | Kelly |
| 2014/0204587 | A1 | 7/2014 | Hukkanen |

FOREIGN PATENT DOCUMENTS

| | | | | | |
|---|---|---|---|---|---|
| EP | 2 865 939 | | | 4/2015 | |
| EP | 3 290 980 | | | 3/2018 | |
| GB | 309668 | | | 4/1929 | |
| GB | 1254228 | | | 11/1971 | |
| WO | 2006/072885 | A1 | | 7/2006 | |
| WO | WO200672885 | | * | 7/2006 | ..... F21V 14/06 |
| WO | 2014/184422 | | | 11/2014 | |
| WO | 2014/195217 | | | 12/2014 | |

OTHER PUBLICATIONS

Written Opinion of the ISA for PCT/FI2020/050029 dated Apr. 6, 2020, 8 pages.
Office Action for FI20195287 dated Sep. 18, 2019, 6 pages.
Search Report for FI20195287 dated Sep. 18, 2019, 2 pages.

* cited by examiner

OPTICAL DEVICE FOR MODIFYING LIGHT DISTRIBUTION

This application is the U.S. national phase of International Application No. PCT/FI2020/050029 filed Jan. 17, 2020 which designated the U.S. and claims priority to FI Patent Application No. 20195287 filed Apr. 8, 2019, the entire contents of each of which are hereby incorporated by reference.

FIELD OF THE DISCLOSURE

The disclosure relates generally to illumination engineering. More particularly, the disclosure relates to an optical device for modifying a distribution of light produced by a light source that can be, for example but not necessarily, a light emitting diode "LED".

BACKGROUND

A distribution of light produced by a light source can be important or even critical in some applications. The light source can be, for example but not necessarily, a light emitting diode "LED", a filament lamp, or a gas-discharge lamp. The distribution of light produced by a light source can be modified with optical devices such as lenses, reflectors, and combined lens-reflector devices that comprise sections which act as lenses and sections which act as reflectors. In many cases there is a need for an optical device that is adjustable for tuning a shape of a light distribution pattern produced by a light source and the optical device. For example, there can be a need to change a width of a light distribution pattern smoothly between a narrow light distribution pattern for illuminating a spot and a wider light distribution pattern for illuminating a larger area.

Publication WO2006072885 describes an optical device for adjusting a shape of a light distribution pattern. The optical device of WO2006072885 comprises a first optical element and a second optical element for modifying a distribution of light produced by a light source. The first and second optical elements are successively in a pathway of the light so that the second optical element receives the light exiting the first optical element. The optical device of WO2006072885 comprises an adjustment mechanism for adjusting the distance between the first and second optical elements along the optical axis of the optical device and thereby for varying the shape of the light distribution pattern. An inconvenience related to the optical device of WO2006072885 is the need for the adjustment mechanism for adjusting the distance between the first and second optical elements along the optical axis of the optical device. A further inconvenience related to the optical device of WO2006072885 is that the physical length of the optical device is changing when the shape of the light distribution pattern is changed. The changing physical length is an unwanted property in conjunction with many illumination applications e.g. in cases where optical devices are embedded in ceiling or wall structures so that a front surface of each optical device is substantially in flush with a wall or ceiling surface.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

In this document, the word "geometric" when used as a prefix means a geometric concept that is not necessarily a part of any physical object. The geometric concept can be for example a geometric point, a straight or curved geometric line, a geometric plane, a non-planar geometric surface, a geometric space, or any other geometric entity that is zero, one, two, or three dimensional.

In accordance with the invention, there is provided a new optical device for modifying a distribution of light produced by a light source.

An optical device according to the invention comprises:

- a first optical element being a first piece of transparent material and comprising a first surface for modifying a distribution of light exiting the first optical element through the first surface, and
- a second optical element being a second piece of transparent material and comprising a second surface facing towards the first surface and for further modifying the distribution of the light entering the second optical element through the second surface.

The second optical element is rotatable with respect to the first optical element around a geometric optical axis of the optical device. One of the above-mentioned first and second surfaces comprises convex areas and the other one of the first and second surfaces comprises concave areas for at least partly compensating for an optical effect of the convex areas when the second optical element is in a first rotational position with respect to the first optical element so that the convex areas and the concave areas are aligned with respect to each other. A combined optical effect of the first and second surfaces is changeable by rotating the second optical element from the first rotational position towards a second rotational position in which the concave areas and the convex areas are non-aligned with respect to each other. Therefore, a shape of a light distribution pattern can be varied without changing the distance between the first and second optical elements i.e. without changing the physical length of the optical device.

The first and second optical elements comprise sliding surfaces for sliding with respect to each other and for mechanically supporting the first and second optical elements with respect to each other in radial directions perpendicular to the geometric optical axis. Therefore, a mechanical structure for supporting the first and second optical elements can be simpler than in a case where optical elements that are rotatable with respect to each other are not provided with sliding surfaces for keeping the optical elements in a desired radial position with respect to each other.

In accordance with the invention, there is provided also a new illumination device that comprises:

- a light source, and
- an optical device according to the invention for modifying a distribution of light emitted by the light source.

The light source may comprise for example one or more light emitting diodes "LED".

In accordance with the invention, there is provided also a new mold set that comprises:

- a first mold having a form suitable for manufacturing, by mold casting, a first piece of transparent material constituting the first optical element of an optical device according to the invention, and a second mold having a form suitable for manufacturing, by mold casting, a second piece of transparent material constituting the second optical element of the optical device according to the invention.

Exemplifying and non-limiting embodiments are described in accompanied dependent claims.

Various exemplifying and non-limiting embodiments both as to constructions and to methods of operation, together with additional objects and advantages thereof, will be best understood from the following description of specific exemplifying embodiments when read in conjunction with the accompanying drawings.

The verbs "to comprise" and "to include" are used in this document as open limitations that neither exclude nor require the existence of also un-recited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

Exemplifying and non-limiting embodiments and their advantages are explained in greater detail below with reference to the accompanying drawings, in which.

DESCRIPTION OF EXEMPLIFYING AND NON-LIMITING EMBODIMENTS

The specific examples provided in the description given below should not be construed as limiting the scope and/or the applicability of the appended claims. Lists and groups of examples provided in the description given below are not exhaustive unless otherwise explicitly stated.

Figure 1A:
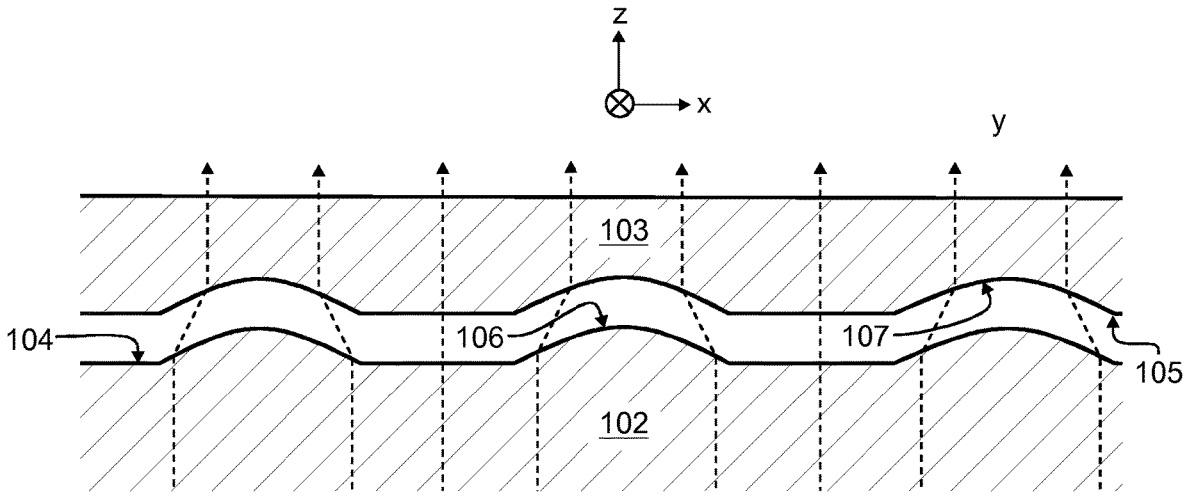
FIGS. 1*a* and 1*b* illustrate details of an optical device according to an exemplifying and non-limiting embodiment.
Figure 1B:
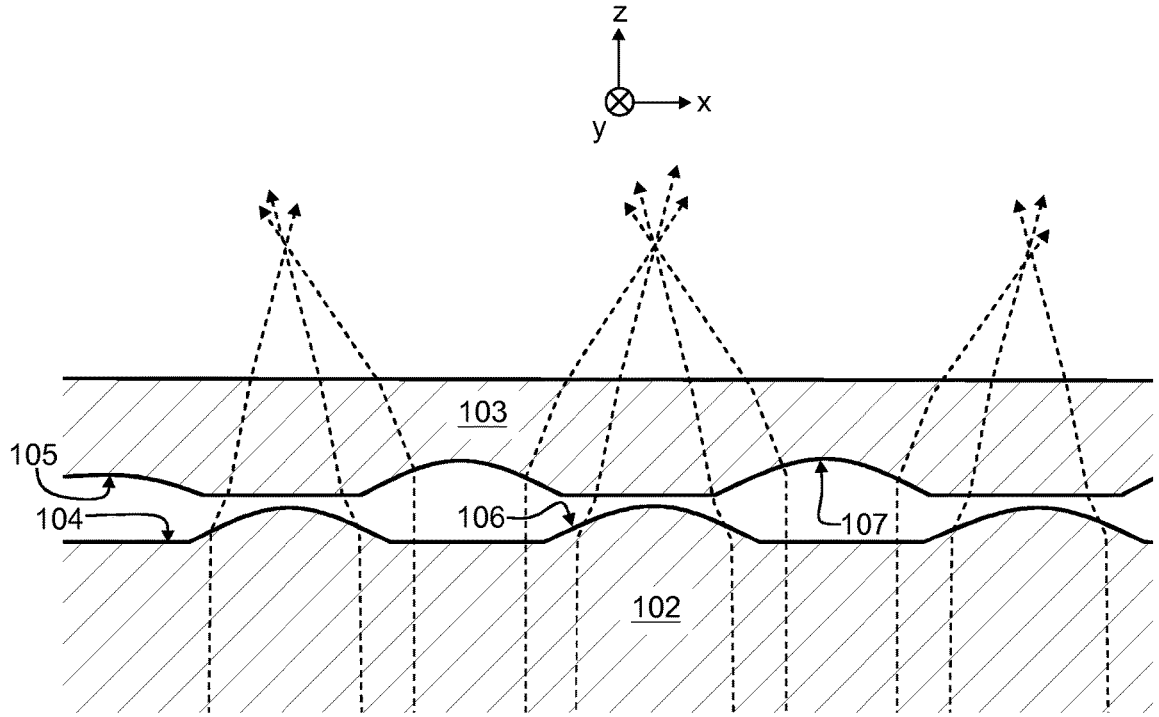

FIGS. 1*a* and 1*b* illustrate details of an optical device according to an exemplifying and non-limiting embodiment. The optical device comprises a first optical element 102 that comprises a first surface 104 for modifying a distribution of light exiting the first optical element 102 through the first surface 104. The optical device comprises a second optical element 103 that comprises a second surface 105 facing towards the first surface 104 of the first optical element 102. The second surface 105 is suitable for further modifying the distribution of the light that has exited the first optical element 102. In FIGS. 1*a* and 1*b*, exemplifying light beams are depicted with dashed line arrows. The second optical element 103 is mechanically supported with respect to the first optical element 102 so that the second surface 105 is movable with respect to the first surface 104 in parallel with the first surface 104. In this exemplifying optical device, the first surface 104 comprises convex areas and the second surface 105 comprises concave areas. In FIGS. 1*a* and 1*b*, one of the convex areas of the first surface 104 is denoted with a reference 106 and one of the concave areas of the second surface 105 is denoted with a reference 107. It is however also possible that the second surface 105 comprises convex areas and the first surface 104 comprises concave areas. As shown in FIG. 1*a*, the concave areas of the second surface 105 compensate at least partly for an optical effect of the convex areas of the first surface 104 when the second optical element 103 is in a first position with respect to the first optical element 102 so that the concave areas of the second surface 105 are aligned with the convex areas of the first surface 104. A combined optical effect of the first and second surfaces 104 and 105 is changeable by moving the second optical element 103 with respect to the first optical element 102. FIG. 1*b* shows an exemplifying situation in which the second optical element 103 is in a second position with respect to the first optical element 102 so that the concave areas of the second surface 105 are not aligned with the convex areas of the first surface 104. As illustrated in FIG. 1*b*, the optical device spreads the originally collimated light.

Figure 2A:
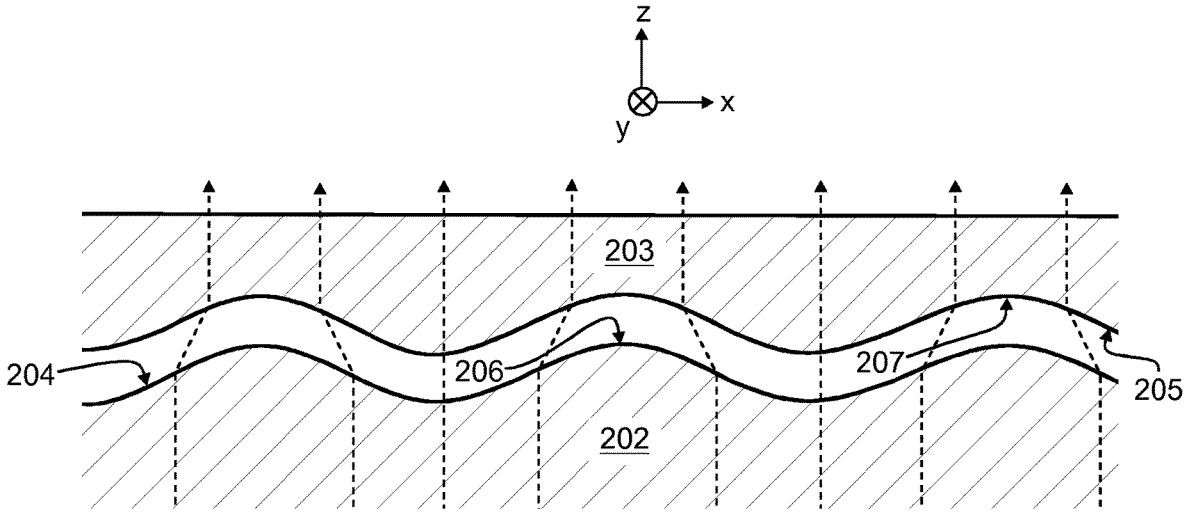
FIGS. 2*a* and 2*b* illustrate details of an optical device according to another exemplifying and non-limiting embodiment.
Figure 2B:
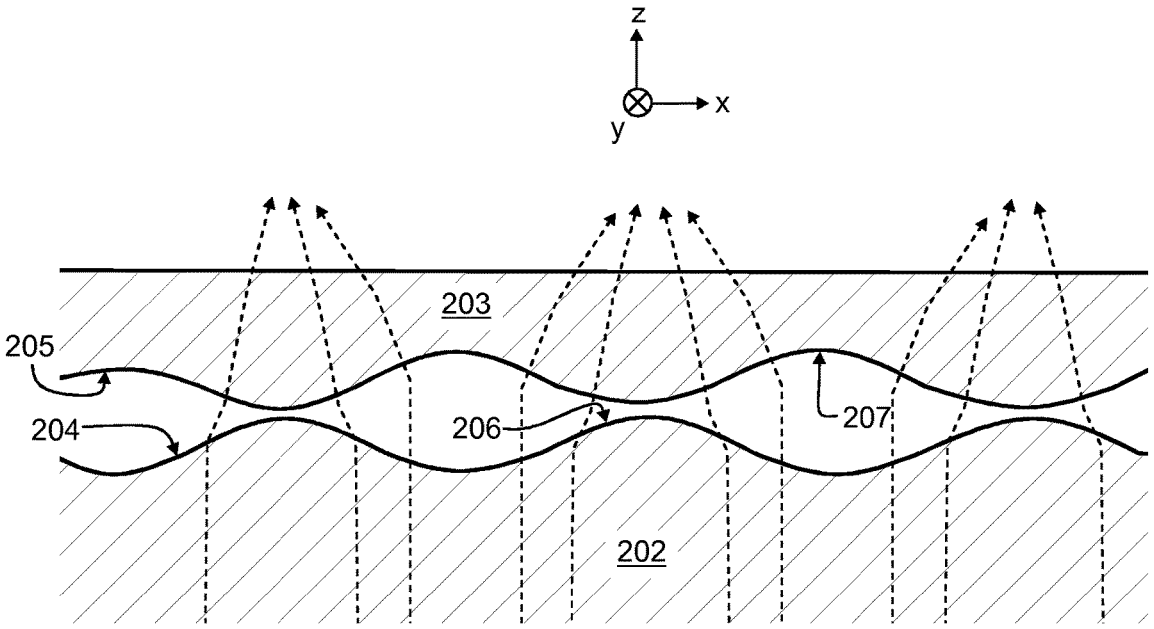

FIGS. 2*a* and 2*b* illustrate details of an optical device according to another exemplifying and non-limiting embodiment. The optical device comprises a first optical element 202 that comprises a first surface 204 for modifying a distribution of light exiting the first optical element 202 through the first surface 204. The optical device comprises a second optical element 203 that comprises a second surface 205 facing towards the first surface 204 of the first optical element 202. The second surface 205 is suitable for further modifying the distribution of the light that has exited the first optical element 202. In FIGS. 2*a* and 2*b*, exemplifying light beams are depicted with dashed line arrows. The second optical element 203 is mechanically supported with respect to the first optical element 202 so that the second surface 205 is movable with respect to the first surface 204 in parallel with the first surface. In this exemplifying optical device, the first surface 204 comprises convex areas and concave areas between the convex areas. Correspondingly, the second surface 205 comprises convex areas and concave areas between the convex areas. In FIGS. 2*a* and 2*b*, one of the convex areas of the first surface 204 is denoted with a reference 206 and one of the concave areas of the second surface 205 is denoted with a reference 207. As shown in FIG. 2*a*, the concave areas of the second surface 205 compensate at least partly for an optical effect of the convex areas of the first surface 204 and correspondingly the convex areas of the second surface 205 compensate at least partly for an optical effect of the concave areas of the first surface 204 when the second optical element 203 is in a first position with respect to the first optical element 202 so that the concave areas of the second surface 205 are aligned with the convex areas of the first surface 204. A combined optical effect of the first and second surfaces 204 and 205 is changeable by moving the second optical element 203 with respect to the first optical element 202. FIG. 2*b* shows an exemplifying situation in which the second optical element 203 is in a second position with respect to the first optical element 202 so that the concave areas of the second surface 205 and the convex areas of the first surface 204 are not aligned with respect to each other. As illustrated in FIG. 2*b*, the optical device spreads the originally collimated light.

Figure 3A:
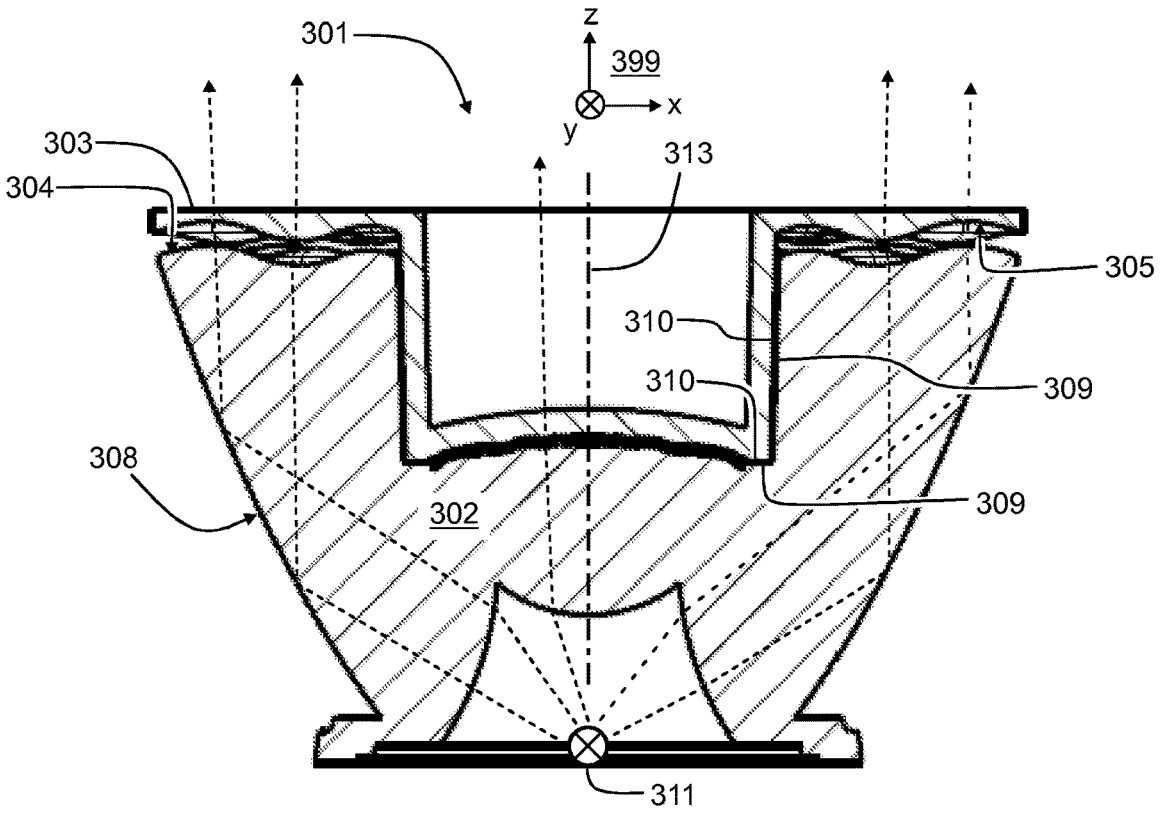
FIGS. 3*a*, 3*b*, 3*c*, and 3*d* illustrate an optical device according to an exemplifying and non-limiting embodiment.
Figure 3B:
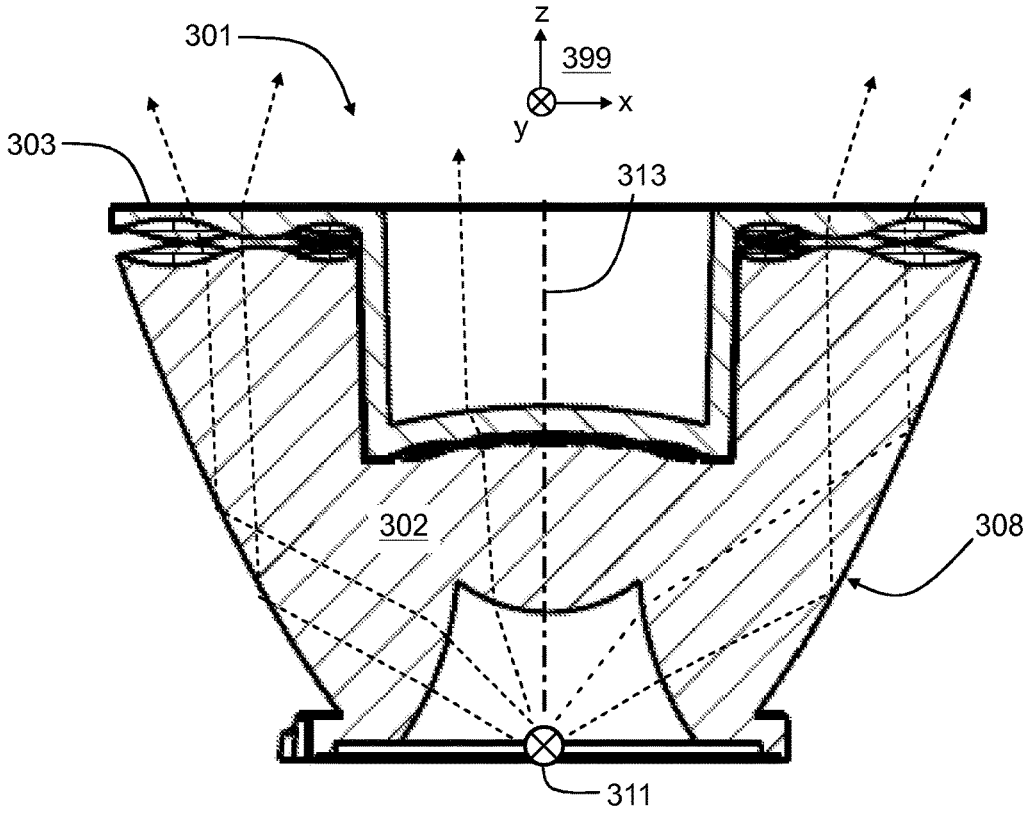
Figure 3C:
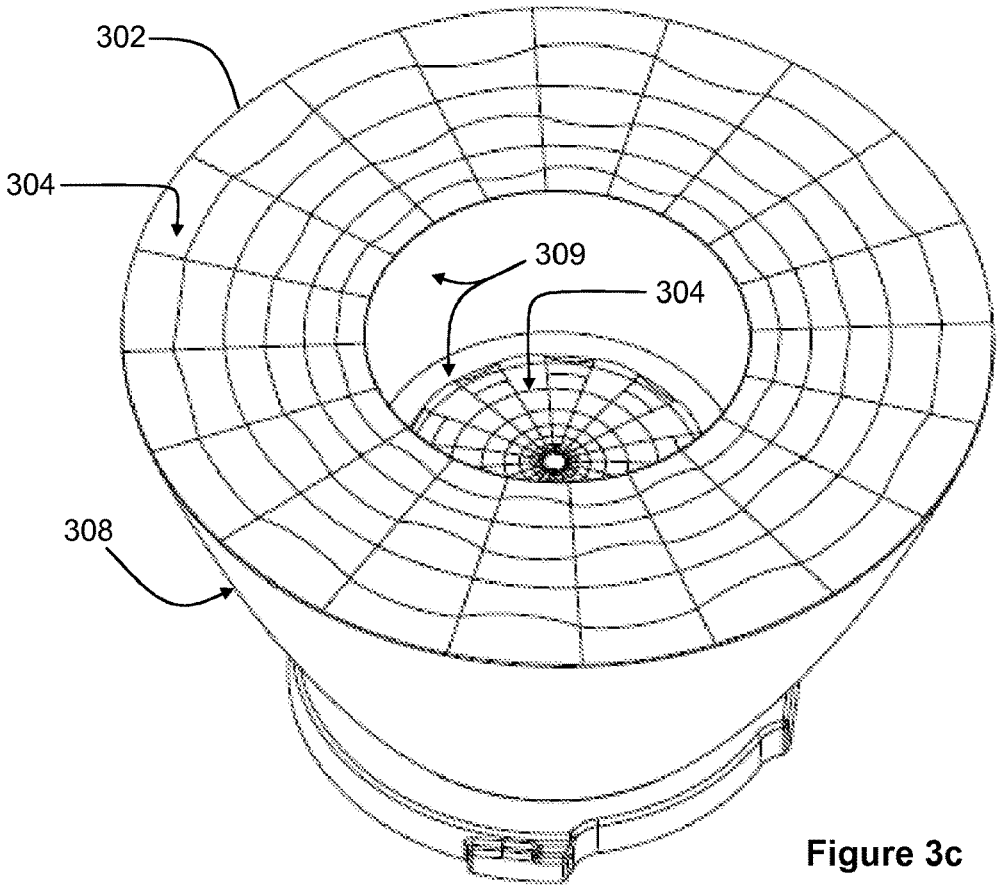
Figure 3D:
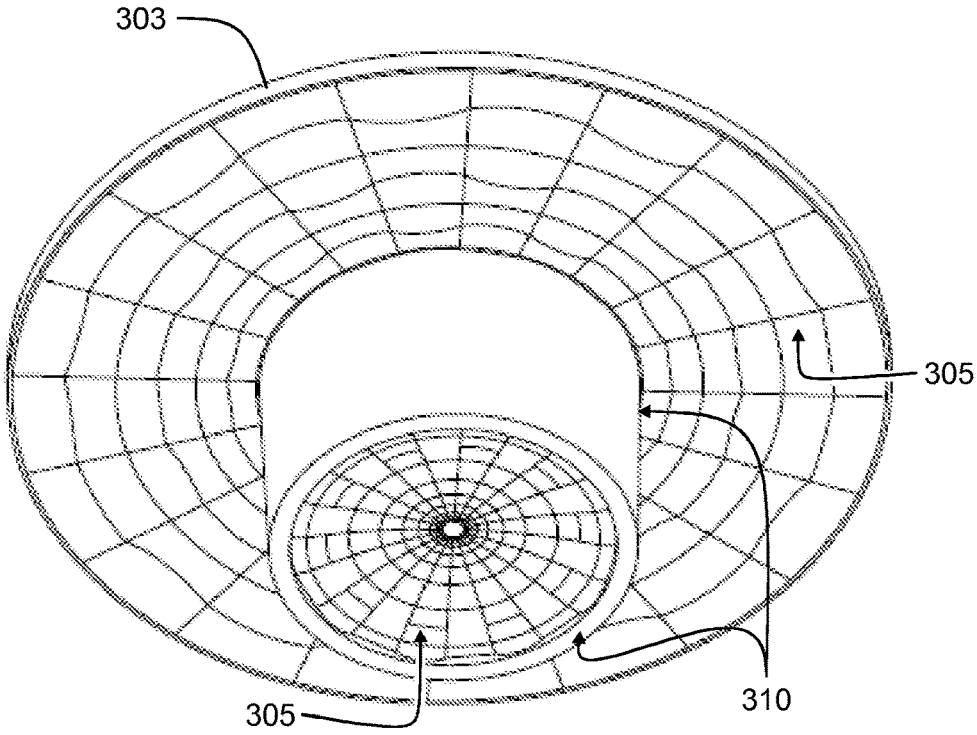

FIGS. 3*a* and 3*b* show section views of an optical device 301 according to an exemplifying and non-limiting embodiment. The geometric section planes are parallel with the xz-plane of a coordinate system 399. The optical device 301 comprises a first optical element 302 that is a piece of transparent material and comprises a first surface 304 for modifying a distribution of light exiting the first optical element 302 through the first surface 304. The optical device 301 comprises a second optical element 303 that is a piece of transparent material and comprises a second surface 305 facing towards the first surface 304 of the first optical element 302. The second surface 305 is suitable for further modifying the distribution of the light that has exited the first optical element 302. The second optical element 303 is rotatable with respect to the first optical element 302 around a geometric optical axis 313 of the optical device 301. The geometric optical axis 313 is parallel with the z-axis of the coordinate system 399. FIG. 3*c* shows an isometric view of the first optical element 302, and FIG. 3*d* shows an isometric view of the second optical element 303.

The first and second optical elements 302 and 303 comprise sliding surfaces 309 and 310 for sliding with respect to each other and for mechanically supporting the first and second optical elements 302 and 303 with respect to each other at least in radial directions perpendicular to the geometric optical axis 313. In this exemplifying optical device 301, the first optical element 302 comprises a cavity that is concentric with the geometric optical axis 313 and the second optical element 303 comprises a projection that is concentric with the geometric optical axis and is in the cavity of the first optical element. Walls of the cavity and the projection constitute the sliding surfaces 309 and 310 for supporting the first and second optical elements with respect to each other. In this exemplifying case, the sliding surfaces 309 and 310 have first portions perpendicular to the radial directions and second portions perpendicular to the geometric optical axis 313. The first portions of the sliding surfaces comprise a cylindrical side surface of the cavity of the first optical element 302 and a cylindrical side surface of the projection of the second optical element 303, and they support the first and second optical elements 302 and 303 with respect to each other in the radial directions. The second portions of the sliding surfaces comprise a part of the bottom of the cavity and a part of an end-surface of the projection, and they support the first and second optical elements 302 and 303 with respect to each other in an axial direction parallel with the geometric optical axis. In this exemplifying case, the second portions of the sliding surfaces determine a minimum distance between the first and second surfaces 304 and 305. It is also possible that first and second optical elements of an optical device according to an exemplifying and non-limiting embodiment comprise e.g. conical sliding surfaces.

In the exemplifying optical device 301 illustrated in FIGS. 3*a*-3*d*, the bottom of the cavity of the first optical element 302 constitutes a part of the optically active first surface 304 and correspondingly the end-surface of the projection of the second optical element 303 constitutes a part of the optically active second surface 305. In this exemplifying case, the projection of the second optical element 302 is hollow as illustrated in FIGS. 3*a* and 3*b*. Therefore, light that propagates in the projection of the second optical element 303 is attenuated less by the transparent material of the second optical element 303 than in a case where a corresponding projection is solid i.e. not hollow. Thus, the construction of the optical device 301 illustrated in FIGS. 3*a*-3*d* is advantageous concerning the mechanical support between the optical elements 302 and 303 as well as optical properties of the optical device 301.

In the exemplifying optical device 301 illustrated in FIGS. 3*a*-3*d*, the first optical element 302 comprises a reflector surface 308 for providing total internal reflection "TIR" to reflect light to the above-mentioned first surface 304. The reflector surface 308 and a surface of the first optical element 302 for receiving the light from a point-form light source 311 can be shaped for example so that the reflected light is collimated light when the point-form light source 311 is in a predetermined position with respect to the optical device 301. In FIGS. 3*a* and 3*b*, exemplifying light beams are depicted with dashed line arrows.

In the exemplifying optical device 301 illustrated in FIGS. 3*a*-3*d*, the above-mentioned first surface 304 of the first optical element 302 comprises convex areas and concave areas between the convex areas. Correspondingly, the above-mentioned second surface 305 of the second optical element 303 comprises convex areas and concave areas between the convex areas. As shown in FIG. 3*a*, the concave areas of the second surface 305 of the second optical element 303 compensate at least partly for an optical effect of the convex areas of the first surface 304 of the first optical element 302 and correspondingly the convex areas of the second surface 305 compensate at least partly for an optical effect of the concave areas of the first surface 304 when the second optical element 303 is in a first rotational position with respect to the first optical element 302 so that the concave areas of the second surface 305 are aligned with the convex areas of the first surface 304. A combined optical effect of the first and second surfaces is changeable by rotating the second optical element 303 with respect to the first optical element 302 around the geometric optical axis 313 of the optical device 301. FIG. 3*b* shows an exemplifying situation in which the second optical element 303 has been rotated so that the concave areas of the second surface 305 of the second optical element 303 are not aligned with the convex areas of the first surface 304 of the first optical element 302. As illustrated in FIG. 3*b*, the first and second surfaces spread the light arriving from the reflector surface 308.

The first and second optical elements 302 and 303 can be manufactured for example with mold casting. The first optical element 302 can be made of for example acrylic plastic, polycarbonate, optical silicone, or glass. Correspondingly, the second optical element 303 can be made of for example acrylic plastic, polycarbonate, optical silicone, or glass.

The optical device 301 and the light source 311 shown in FIGS. 3*a* and 3*b* constitute an illumination device according to an exemplifying and non-limiting embodiment. The illumination device further comprises mechanical support structures for mechanically supporting the optical device 301 and the light source 311. The mechanical support structures are not shown in FIGS. 3*a* and 3*b*.

Figure 4A:
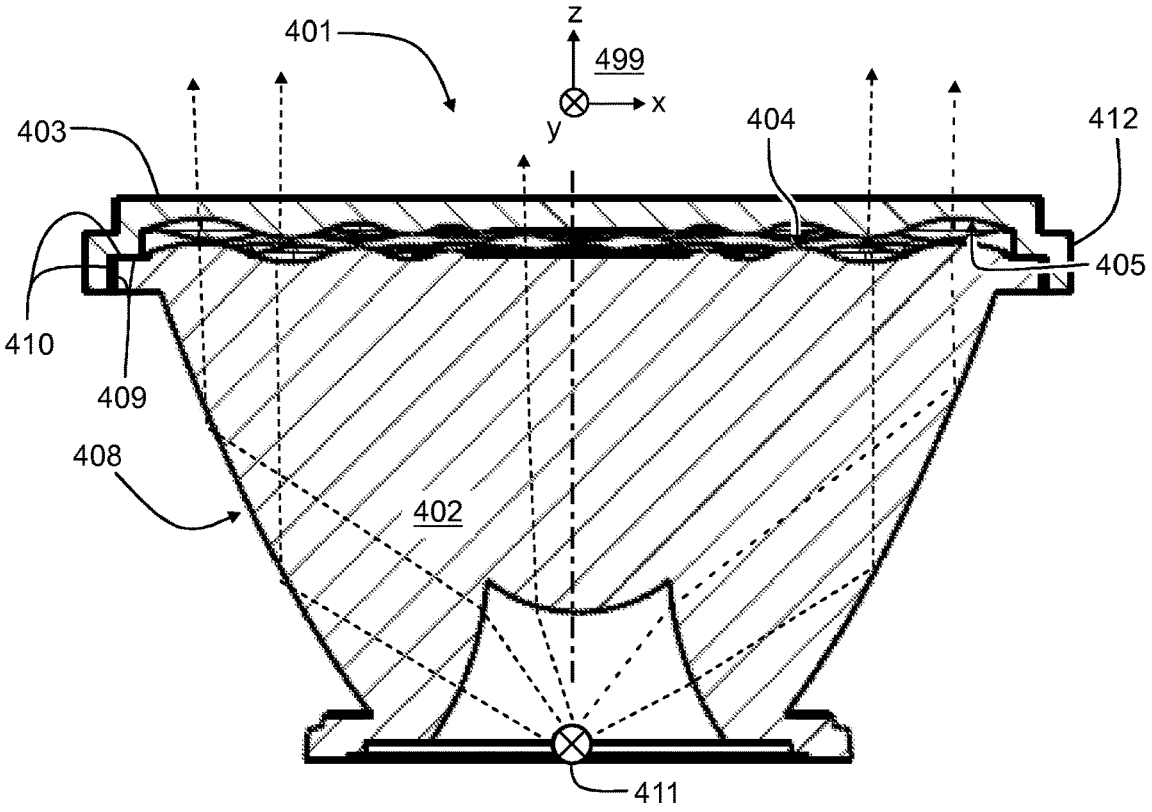
FIGS. 4*a*, 4*b*, 4*c*, and 4*d* illustrate an optical device according to an exemplifying and non-limiting embodiment.
Figure 4B:
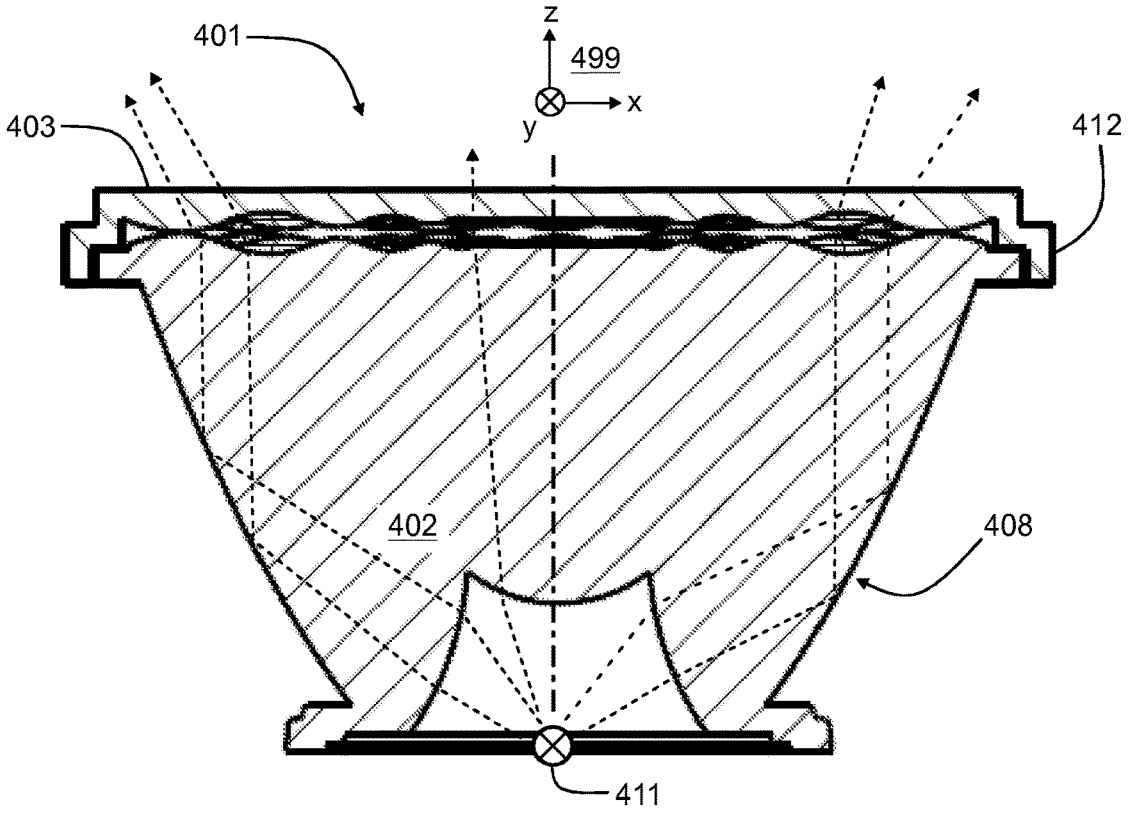
Figure 4C:
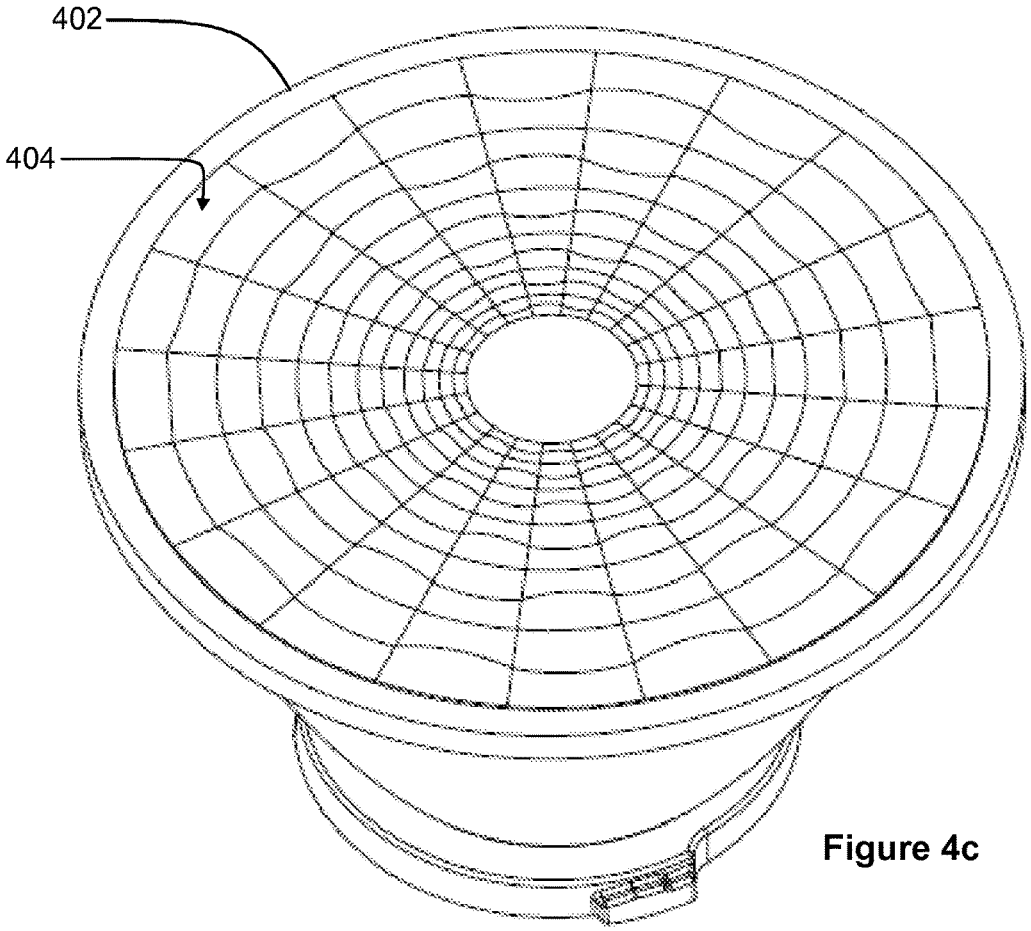
Figure 4D:
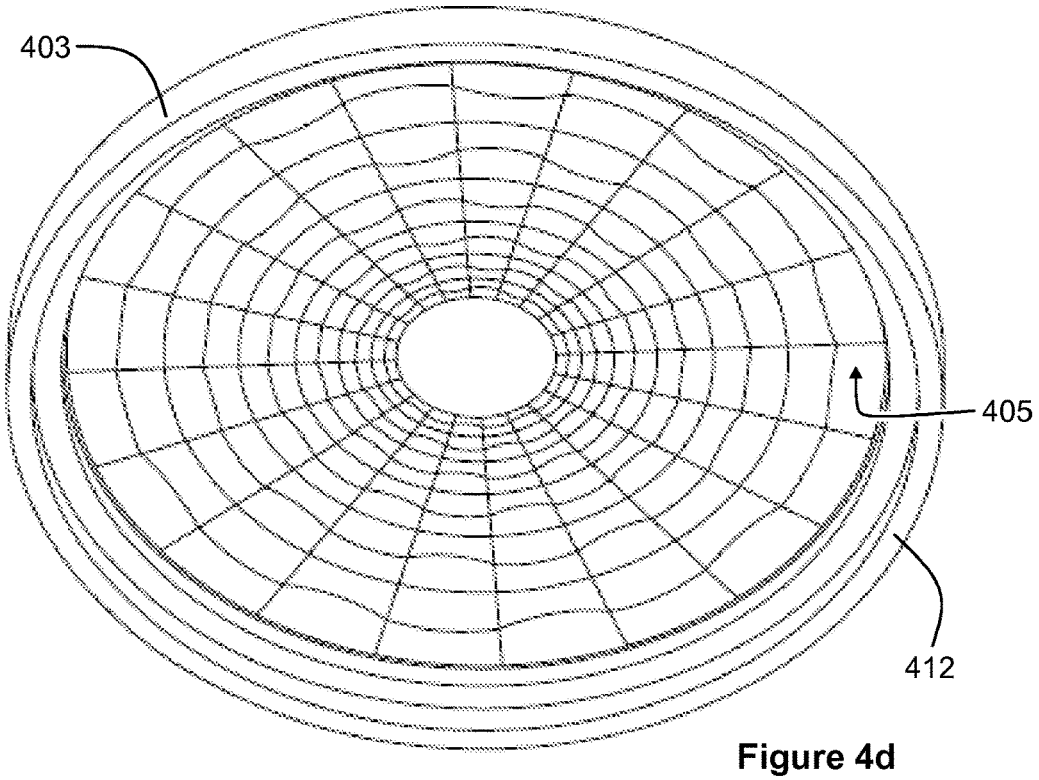

FIGS. 4*a* and 4*b* show section views of an optical device 401 according to an exemplifying and non-limiting embodiment. The geometric section planes are parallel with the xz-plane of a coordinate system 499. The optical device comprises a first optical element 402 that is a piece of transparent material and comprises a first surface 404 for modifying a distribution of light exiting the first optical element 402 through the first surface. In this exemplifying optical device 401, the first optical element 402 comprises a reflector surface 408 for providing total internal reflection "TIR" to reflect light to the above-mentioned first surface 404. In FIGS. 4*a* and 4*b*, exemplifying light beams are depicted with dashed line arrows. The optical device 401 comprises a second optical element 403 that is a piece of transparent material and comprises a second surface 405 facing towards the first surface 404 of the first optical element 402. The second surface is suitable for further modifying the distribution of the light that has exited the first optical element 402. The second optical element 403 is rotatable with respect to the first optical element 402 around a geometric optical axis of the optical device. The geometric optical axis is parallel with the z-axis of the coordinate system 499. FIG. 4*c* shows an isometric view of the first optical element 402, and FIG. 4*d* shows an isometric view of the second optical element 403.

The first and second optical elements 402 and 403 comprise sliding surfaces 409 and 410 for sliding with respect to each other and for mechanically supporting the first and second optical elements with respect to each other at least in radial directions perpendicular to the geometric optical axis. In this exemplifying optical device 401, the sliding surface 409 of the first optical element 402 is on an outer rim of the first optical element and the second optical element comprises a rim section 412 surrounding the sliding surface 409 of the first optical element.

In the exemplifying optical device 401 illustrated in FIGS. 4*a*-4*d*, the above-mentioned first surface 404 of the first optical element 402 comprises convex areas and concave areas between the convex areas. Correspondingly, the above-mentioned second surface 405 of the second optical element 403 comprises convex areas and concave areas between the convex areas. As shown in FIG. 4*a*, the concave areas of the second surface 405 of the second optical element 403 compensate at least partly for an optical effect of the convex areas of the first surface 404 of the first optical element 402 and correspondingly the convex areas of the second surface 405 compensate at least partly for an optical effect of the concave areas of the first surface 404 when the second optical element 403 is in a first rotational position with respect to the first optical element 402 so that the concave areas of the second surface 405 are aligned with the convex areas of the first surface 404. A combined optical effect of the first and second surfaces is changeable by rotating the second optical element 403 with respect to the first optical element 402 around the geometric optical axis of the optical device 401. FIG. 4*b* shows an exemplifying situation in which the second optical element 403 has been rotated so that the concave areas of the second surface of the second optical element 403 are not aligned with the convex areas of the first surface of the first optical element 402. As illustrated in FIG. 4*b*, the first and second surfaces spread the light arriving from the reflector surface 408.

Figure 5:
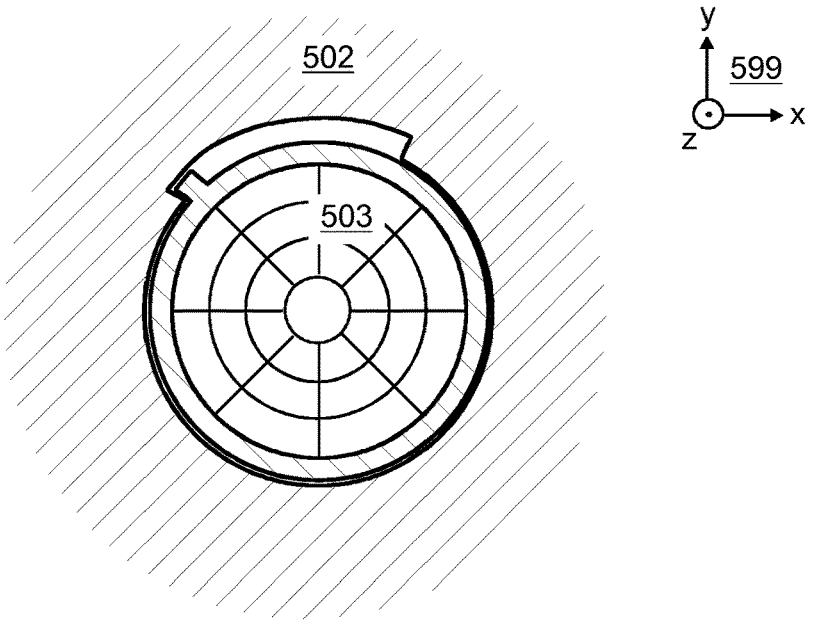
FIGS. 5 and 6 illustrate details of optical devices according to exemplifying and non-limiting embodiments.

In an optical device according to an exemplifying and non-limiting embodiment, the first and second optical elements are shaped to form a limiter which limits an angle of rotation of the second optical element with respect to the first optical element. Extreme rotational positions of the second optical element with respect to the first optical element can be for example such that optical effects of the above-mentioned first and second surfaces compensate for each other as much as possible in one extreme rotational position, i.e. convex and concave areas are aligned with each other, whereas, in the other extreme rotational position, the first and second surfaces spread light as much as possible. FIG. 5 illustrates a detail of an optical device according to this exemplifying and non-limiting embodiment. The optical axis of the optical device is parallel with the z-axis of a coordinate system 599. FIG. 5 shows partial section views of first and second optical elements 502 and 503. In other respects, the first and second optical elements 502 and 503 can be for example like the first and second optical elements 302 and 303 illustrated in FIGS. 3*a*-3*d*.

Figure 6:
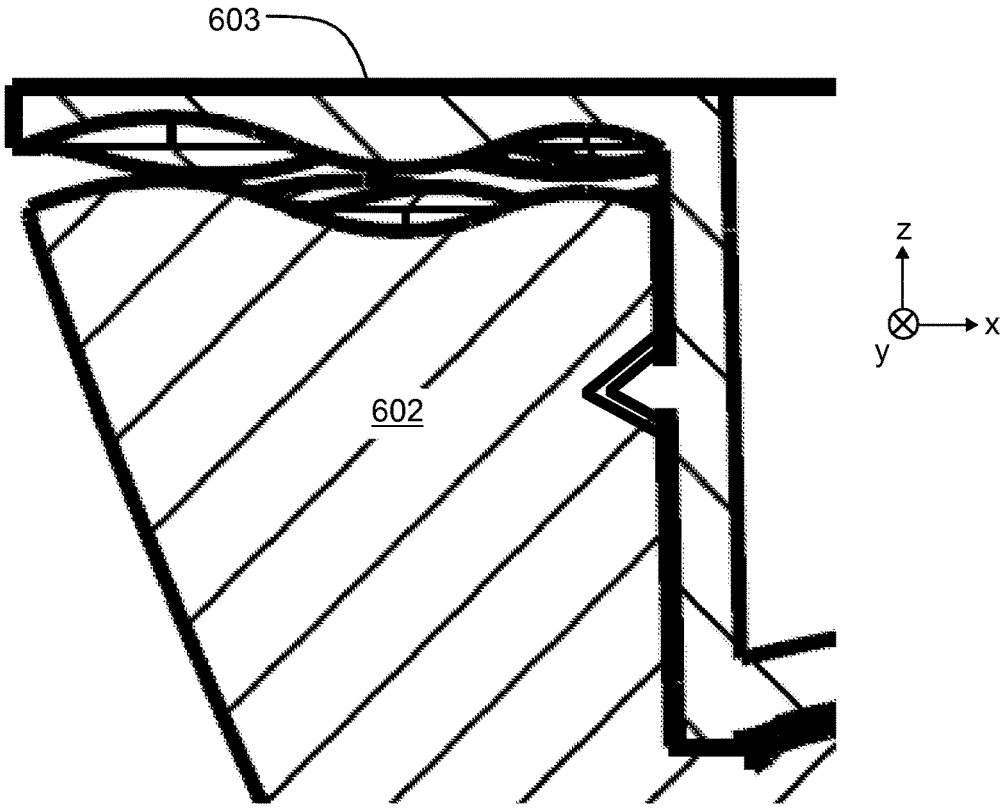

In an optical device according to an exemplifying and non-limiting embodiment, one of the first and second optical elements comprises one or more grooves whose depth directions are radial and longitudinal directions are circumferential with respect to rotation between the first and second optical elements, and the other one of the first and second optical elements comprises one or more radially directed projections in the one or more grooves. The one or more grooves and the one or more projections are suitable for shape locking the first and second optical elements together in a direction parallel with the geometric optical axis. Installation of the second optical element on the first optical element can be based on flexibility of the transparent material of the first optical element and/or on flexibility of the transparent material of the second optical element. FIG. 6 illustrates a detail of an optical device according to this exemplifying and non-limiting embodiment. FIG. 6 shows partial section views of first and second optical elements 602 and 603. In other respects, the first and second optical elements 602 and 603 can be like the first and second optical elements 302 and 303 illustrated in FIGS. 3*a*-3*d*.

Figure 7A:
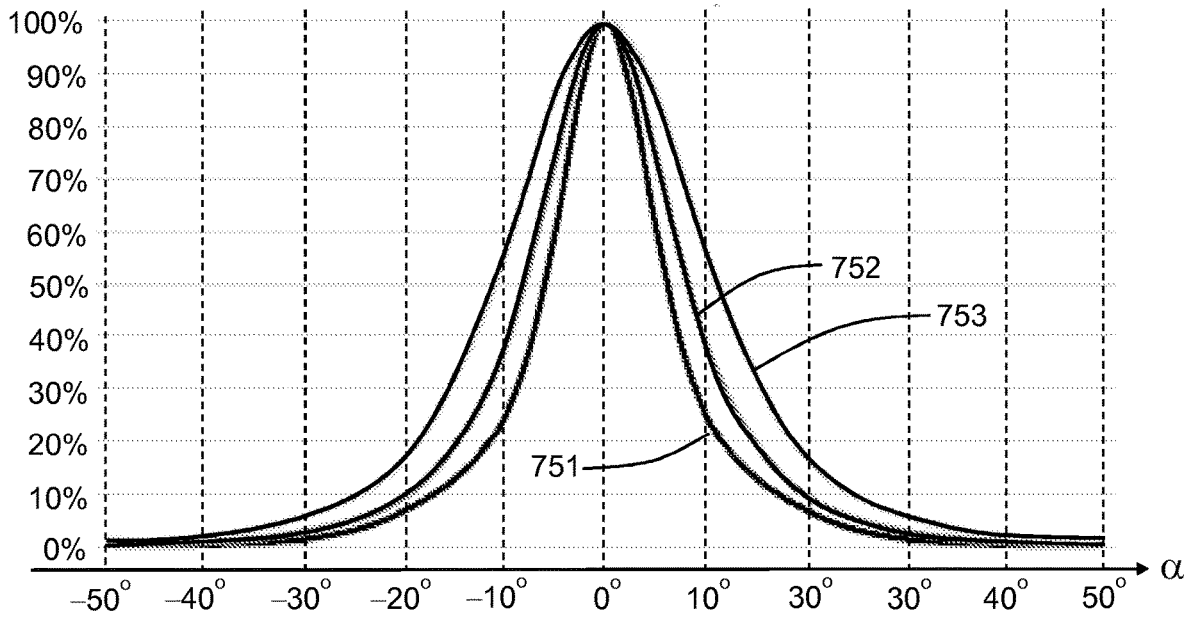
FIG. 7*a* illustrates light distribution patterns produced by an illumination device according to an exemplifying and non-limiting embodiment shown in FIG. 7*b*.
Figure 7B:
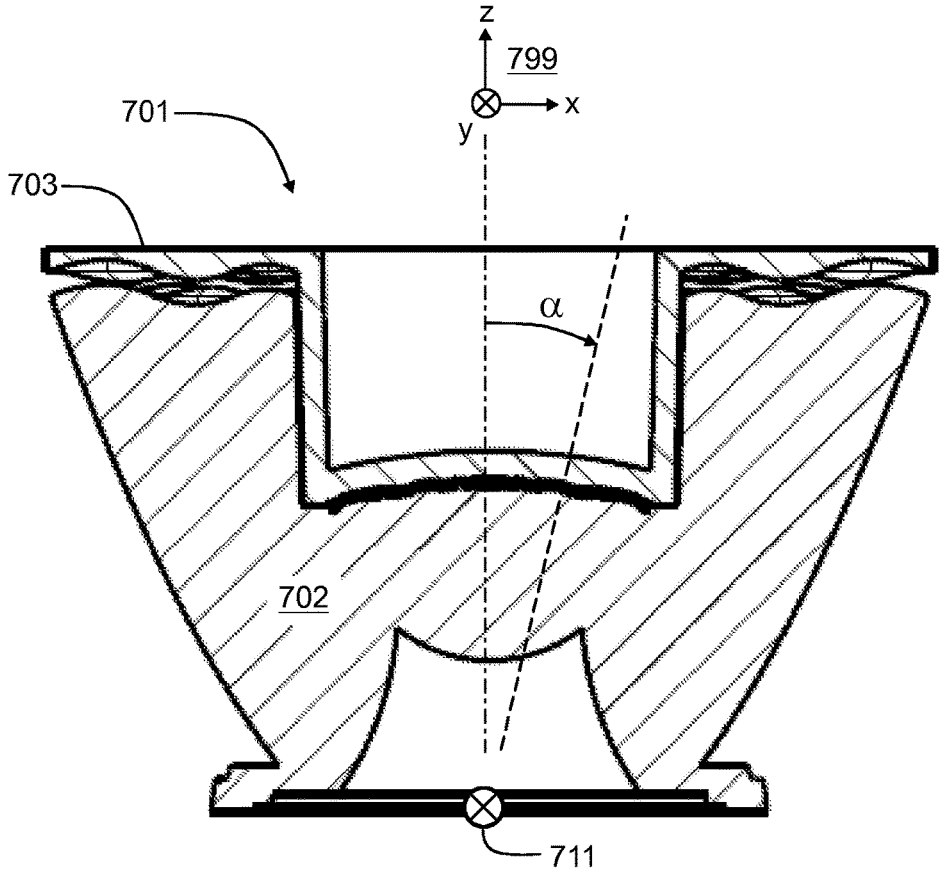

FIG. 7*a* illustrates light distribution patterns produced by an illumination device according to an exemplifying and non-limiting embodiment. A section view of the illumination device is shown in FIG. 7*b*. The geometric section plane is parallel with the xz-plane of a coordinate system 799. The illumination device comprises a light source 711 and an optical device 701 according to an exemplifying and non-limiting embodiment. The optical device 701 comprises a first optical element 702 and a second optical element 703. The first optical element 702 comprises a first surface for modifying a distribution of light exiting the first optical element 702 through the first surface, and the second optical element 703 comprises a second surface facing towards the first surface and for further modifying the distribution of the light that has exited the first optical element 702. The first and second surfaces comprise convex areas and concave areas. The first surface of the first optical element 702 can be for example such as shown in FIG. 3*c*, and the second surface of the second optical element 703 can be for example such as shown in FIG. 3*d*. FIG. 7*b* shows an exemplifying situation where the concave areas of the second surface of the second optical element 703 are aligned with the convex areas of the first surface of the first optical element 702. An optical effect of the optical device 701 is changeable by rotating the second optical element 703 with respect to the first optical element 702 around a geometric optical axis of the optical device 701. The geometric optical axis is parallel with the z-axis of the coordinate system 799. In FIG. 7*b*, the geometric optical axis is depicted with a dash-and-dot line.

Each of curves 751, 752, and 753 shown in FIG. 7*a* represents normalized luminous intensity as a function of an angle $\alpha$ between a viewing direction and the geometric optical axis of the optical device 701. The angle $\alpha$ is shown in FIG. 7*b*. The normalized luminous intensity depicted with the curve 751 corresponds to the exemplifying situation shown in FIG. 7*b* where the concave areas of the second surface of the second optical element 703 are aligned with the convex areas of the first surface of the first optical element 702. The normalized luminous intensity depicted with the curve 752 corresponds to an exemplifying situation in which the second optical element 703 has been rotated by an angle of 5 degrees around the geometric optical axis from the position shown in FIG. 7*b*. The normalized luminous intensity depicted with the curve 753 corresponds to an exemplifying situation in which the second optical element 703 has been rotated by an angle of 10 degrees around the geometric optical axis from the position shown in FIG. 7*b*.

The specific examples provided in the description given above should not be construed as limiting the scope and/or the applicability of the appended claims. Lists and groups of examples provided in the description given above are not exhaustive unless otherwise explicitly stated.

What is claimed is:

1. An optical device for modifying light distribution, the optical device comprising:

a first optical element being a first piece of transparent material and comprising a first surface for modifying a distribution of light exiting the first optical element through the first surface; and a second optical element being a second piece of transparent material and comprising a second surface facing towards the first surface and for further modifying the distribution of the light entering the second optical element through the second surface, wherein the second optical element is rotatable with respect to the first optical element around a geometric optical axis of the optical device, and one of the first and second surfaces comprises convex areas and another one of the first and second surfaces comprises concave areas for at least partly compensating for an optical effect of the convex areas when the second optical element is in a first rotational position with respect to the first optical element so that the convex areas and the concave areas are aligned with respect to each other, wherein a combined optical effect of the first and second surfaces is changeable by rotating the second optical element from the first rotational position towards a second rotational position in which the concave areas and the convex areas are non-aligned with respect to each other, wherein the first and second optical elements comprise sliding surfaces for sliding with respect to each other and for mechanically supporting the first and second optical elements with respect to each other in radial directions perpendicular to the geometric optical axis, wherein the first optical element comprises a cavity concentric with the geometric optical axis and the second optical element comprises a projection concentric with the geometric optical axis and being in the cavity of the first optical element, walls of the cavity and the projection constituting the sliding surfaces for supporting the first and second optical elements with respect to each other in the radial directions, and wherein a bottom of the cavity of the first optical element constitutes a part of the first surface of the first optical element and an end-surface of the projection of the second optical element facing towards the bottom of the cavity constitutes a part of the second surface of the second optical element.

2. The optical device according to claim 1, wherein the sliding surfaces are shaped to mechanically support the first and second optical elements with respect to each other in an axial direction parallel with the geometric optical axis.

3. The optical device according to claim 2, wherein the sliding surfaces have first portions perpendicular to the radial directions and for mechanically supporting the first and second optical elements with respect to each other in the radial directions, and second portions perpendicular to the axial direction and for mechanically supporting the first and second optical elements with respect to each other in the axial direction.

4. The optical device according to claim 1, wherein the projection of the second optical element is hollow.

5. The optical device according to claim 1, wherein the sliding surface of the first optical element is on an outer rim of the first optical element and the second optical element comprises a rim section surrounding the sliding surface of the first optical element.

6. The optical device according to claim 1, wherein the first surface comprises the convex areas, the second surface comprises the concave areas, the first surface comprises other concave areas between the convex areas of the first surface, and the second surface comprises other convex areas between the concave areas of the second surface.

7. The optical device according to claim 1, wherein the first optical element comprises a reflector surface for reflecting the light to the first surface.

8. The optical device according to claim 7, wherein the reflector surface and a surface of the first optical element for receiving the light from a point-form light source are shaped so that the reflected light is collimated light when the point-form light source is in a predetermined position with respect to the optical device.

9. The optical device according to claim 1, wherein the first and second optical elements are shaped to form a limiter which limits an angle of rotation of the second optical element with respect to the first optical element.

10. The optical device according to claim 1, wherein one of the first and second optical elements comprises one or more grooves whose depth directions are radial and longitudinal directions are circumferential with respect to rotation between the first and second optical elements, and another one of the first and second optical elements comprises one or more radially directed projections in the one or more grooves, the one or more grooves and the one or more projections being suitable for shape locking the first and second optical elements together in an axial direction parallel with the geometric optical axis.

11. The optical device according to claim 1, wherein the first optical element is made of one of the following: acrylic plastic, polycarbonate, optical silicone, glass, and wherein the second optical element is made of one of the following: acrylic plastic, polycarbonate, optical silicone, glass.

12. A set of molds, comprising:

a first mold having a form suitable for manufacturing, by mold casting, a first piece of transparent material constituting a first optical element of an optical device; and a second mold having a form suitable for manufacturing, by mold casting, a second piece of transparent material constituting a second optical element of the optical device, wherein the first optical element comprises a first surface for modifying a distribution of light exiting the first optical element through the first surface, wherein the second optical element comprises a second surface facing towards the first surface and for further modifying the distribution of the light entering the second optical element through the second surface, wherein the second optical element is rotatable with respect to the first optical element around a geometric optical axis of the optical device, and one of the first and second surfaces comprises convex areas and another one of the first and second surfaces comprises concave areas for at least partly compensating for an optical effect of the convex areas when the second optical element is in a first rotational position with respect to the first optical element so that the convex areas and the concave areas are aligned with respect to each other, and wherein a combined optical effect of the first and second surfaces is changeable by rotating the second optical element from the first rotational position towards a second rotational position in which the concave areas and the convex areas are non-aligned with respect to each other, wherein the first and second optical elements comprise sliding surfaces for sliding with respect to each other and for mechanically supporting the first and second optical elements with respect to each other in radial directions perpendicular to the geometric optical axis, wherein the first optical element comprises a cavity concentric with the geometric optical axis and the second optical element comprises a projection concentric with the geometric optical axis and being in the cavity of the first optical element, walls of the cavity and the projection constituting the sliding surfaces for supporting the first and second optical elements with respect to each other in the radial directions, and wherein a bottom of the cavity of the first optical element constitutes a part of the first surface of the first optical element and an end-surface of the projection of the second optical element facing towards the bottom of the cavity constitutes a part of the second surface of the second optical element.

13. An illumination device, comprising:

a light source; and an optical device for modifying a distribution of light emitted by the light source, wherein the optical device comprises:

a first optical element being a first piece of transparent material and comprising a first surface for modifying the distribution of the light when the light exits the first optical element through the first surface, and a second optical element being a second piece of transparent material and comprising a second surface facing towards the first surface and for further modifying the distribution of the light entering the second optical element through the second surface, wherein the second optical element is rotatable with respect to the first optical element around a geometric optical axis of the optical device, and one of the first and second surfaces comprises convex areas and another one of the first and second surfaces comprises concave areas for at least partly compensating for an optical effect of the convex areas when the second optical element is in a first rotational position with respect to the first optical element so that the convex areas and the concave areas are aligned with respect to each other, wherein a combined optical effect of the first and second surfaces is changeable by rotating the second optical element from the first rotational position towards a second rotational position in which the concave areas and the convex areas are non-aligned with respect to each other, wherein the first and second optical elements comprise sliding surfaces for sliding with respect to each other and for mechanically supporting the first and second optical elements with respect to each other in radial directions perpendicular to the geometric optical axis, wherein the first optical element comprises a cavity concentric with the geometric optical axis and the second optical element comprises a projection concentric with the geometric optical axis and being in the cavity of the first optical element, walls of the cavity and the projection constituting the sliding surfaces for supporting the first and second optical elements with respect to each other in the radial directions, and wherein a bottom of the cavity of the first optical element constitutes a part of the first surface of the first optical element and an end-surface of the projection of the second optical element facing towards the bottom of the cavity constitutes a part of the second surface of the second optical element.

14. The optical device according to claim 2, wherein the sliding surface of the first optical element is on an outer rim of the first optical element and the second optical element comprises a rim section surrounding the sliding surface of the first optical element.

15. The optical device according to claim 3, wherein the sliding surface of the first optical element is on an outer rim of the first optical element and the second optical element comprises a rim section surrounding the sliding surface of the first optical element.

16. The optical device according to claim 2, wherein the first surface comprises the convex areas, the second surface comprises the concave areas, the first surface comprises other concave areas between the convex areas of the first surface, and the second surface comprises other convex areas between the concave areas of the second surface.

* * * * *